US006746573B2

(12) United States Patent
Stelljes, Jr. et al.

(10) Patent No.: US 6,746,573 B2
(45) Date of Patent: Jun. 8, 2004

(54) METHOD OF DRYING FIBROUS STRUCTURES

(75) Inventors: Michael Gomer Stelljes, Jr., West Chester, OH (US); Osman Polat, Montgomery, OH (US); Donald Eugene Ensign, Cincinnati, OH (US); Paul Dennis Trokhan, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/929,599

(22) Filed: Aug. 14, 2001

(65) Prior Publication Data

US 2003/0033727 A1 Feb. 20, 2003

(51) Int. Cl.[7] ..... D21F 11/00; F26B 5/04

(52) U.S. Cl. ..... 162/205; 162/206; 162/207; 34/406; 34/412; 34/414; 34/453

(58) Field of Search ..... 162/109, 111, 162/112, 205, 207, 204, 206; 34/453, 115, 117, 406, 412, 125, 414

(56) References Cited

U.S. PATENT DOCUMENTS 3,284,285 A * 11/1966 Holden ..... 162/297
4,440,597 A 4/1984 Wells et al.
4,528,239 A 7/1985 Trokhan
4,556,450 A 12/1985 Chuang et al.
5,274,930 A 1/1994 Ensign et al.
5,581,906 A 12/1996 Ensign et al.
5,584,126 A 12/1996 Ensign et al.
5,598,643 A 2/1997 Chuang et al.
5,699,626 A 12/1997 Chuang et al.
5,701,682 A 12/1997 Chuang et al.
5,938,893 A 8/1999 Trokhan et al.
5,942,322 A 8/1999 Ensign et al.
6,021,583 A 2/2000 Stelljes, Jr. et al.
6,105,276 A 8/2000 Ensign et al.

FOREIGN PATENT DOCUMENTS

WO WO 99/53136 10/1999

* cited by examiner

*Primary Examiner*—Steven P. Griffin
*Assistant Examiner*—Mark Halpern
(74) *Attorney, Agent, or Firm*—David K. Mattheis; C. Brant Cook; David M. Weirich

(57) ABSTRACT

A method for drying fibrous webs utilizing a limiting orifice medium with a plurality of pores. The web is disposed on a supporting fluid permeable carrier. The web is pressed between the supporting carrier and the limiting orifice medium. A vacuum greater than the breakthrough pressure of the pores of the medium is drawn through the pores and the web.

28 Claims, 6 Drawing Sheets

METHOD OF DRYING FIBROUS STRUCTURES

FIELD OF THE INVENTION

The present invention relates to drying fibrous structures, and particularly to drying fibrous structures using a limiting orifice drying media.

BACKGROUND OF THE INVENTION

Fibrous structures have become a staple of everyday life. Although the method of the present invention is particularly useful for drying wet laid fibrous structures as herein disclosed, the method is not considered limited to to such an application. The method may also be used to dry nonwoven structures of synthetic, natural or a combination of fibers. The method can also be used for drying woven fibrous structures as well.

Cellulosic fibrous structures are found in facial tissues, toilet tissues and paper toweling. One advance in the art of cellulosic fibrous structures is to provide multiple regions in the cellulosic fibrous structure. A cellulosic fibrous structure is considered to have multiple regions when one region of the cellulosic fibrous structure differs from adjacent regions of the cellulosic fibrous structure by at least one intensive property including but not limited to: basis weight, density, opacity, permeability, and predicted average pore size.

In the manufacture of cellulosic fibrous structures, a slurry of cellulosic fibers dispersed in a liquid carrier is deposited onto a forming wire creating a wet web. Any one of, or combination of, several known means may be used to dry the wet web. Each drying means will affect the properties of the resulting cellulosic fibrous structure. For example, the drying means and process can influence the softness, caliper, tensile strength, and absorbency of the resulting cellulosic fibrous structure. Also the means and process used to dry the cellulosic fibrous structure affect the rate at which it can be manufactured, without being rate-limited by such drying means and process.

An example of one drying means is felt belts. Felt drying belts have long been used to dewater a cellulosic fibrous structure through capillary flow of the liquid carrier into a permeable felt medium held in contact with the web. Dewatering a cellulosic fibrous structure into and by using a felt belt results in overall uniform compression and compaction of the cellulosic fibrous structure web to be dried.

Felt belt drying may be assisted by a vacuum, or may be assisted by opposed press rolls. The press rolls maximize the mechanical compression of the felt against the cellulosic fibrous structure. Examples of felt belt drying are illustrated in U.S. Pat. Nos. 4,329,201 issued May 11, 1982 to Bolton and 4,888,096 issued Dec. 19, 1989 to Cowan et al. One issue associated with the use of felt belts for drying is the rewet of the cellulosic structure as the belt and structure leave the nip point of the press rolls. When the pressure of the rolls is removed, water present in the felts can move back into the cellulosic structure.

Generally, a felt belt is not preferred for the production and drying of a cellulosic fibrous structure having multiple regions. The uniform compression of the fibrous structure by the felt belts reduces the density differences between the regions. Other drying means, which avoid this overall compression of the cellulosic fibrous structure, are more preferable.

Drying cellulosic fibrous structures through vacuum dewatering, without the aid of felt belts, is known in the art.

Vacuum dewatering of the cellulosic fibrous structure mechanically removes moisture from the cellulosic fibrous structure while the moisture is in the liquid form. Furthermore, the vacuum deflects discrete regions of the cellulosic fibrous structure into the structure of the drying belts. Such deflection strongly contributes to having different amounts of moisture in the various regions of the cellulosic fibrous structure. Similarly, drying a cellulosic fibrous structure through a vacuum-assisted capillary flow, using a porous cylinder having preferential pore sizes is known in the art as well. Examples of such vacuum-driven drying techniques are illustrated in commonly assigned U.S. Pat. No. 4,556,450 issued Dec. 3, 1985 to Chuang et al. and U.S. Pat. No. 4,973,385 issued Nov. 27, 1990 to Jean et al.

In another drying process; considerable success has been achieved drying the web of cellulosic fibrous structures by through-air drying. In a typical through-air drying process, a foraminous air-permeable belt supports the web to be dried. Hot air flows through the web, then through the air-permeable belt or vice versa. The air flow principally dries the web by evaporation. Regions coincident with and deflected into the foramina in the air-permeable belt are preferentially dried and the caliper of the resulting cellulosic fibrous structure is increased. Regions coincident the knuckles in the air-permeable belt are dried to a lesser extent.

Several improvements to the air-permeable belts used in through-air drying have been accomplished in the art. For example, the air-permeable belt may be made with a high open area (at least twenty-five percent). Or, the belt may be made to have reduced air permeability. Reduced air permeability may be accomplished by applying a resinous mixture to obturate the interstices between woven yarns in the belt. The drying belt may be impregnated with metallic particles to increase its thermal conductivity and reduce its emissivity or, alternatively, the drying belt may be constructed from a photosensitive resin comprising a continuous network. The drying belt may be specially adapted for high temperature air flows, of up to about 300 degrees C. (575 degrees F.). Examples of such through-air drying technology are found in U.S. Pat. No. Re. 28459 reissued Jul. 1, 1975 to Cole et al., U.S. Pat. Nos. 4,172,910 issued Oct. 30, 1979 to Rotar, 4,251,928 issued Feb. 24, 1981 to Rotar et al., commonly assigned U.S. Pat. No. 4,528,239 issued Jul. 9, 1985 to Trokhan, and U.S. Pat. No. 4,921,750 issued May 1, 1990 to Todd.

Additionally, several attempts have been made in the art to regulate the drying profile of the cellulosic fibrous structure while it is still a web to be dried. Such attempts may use either the drying belt, or an infrared dryer in combination with a Yankee hood. Examples of profiled drying are illustrated in U.S. Pat. Nos. 4,583,302 issued Apr. 22, 1986 to Smith and 4,942,675 issued Jul. 24, 1990 to Sundovist.

The foregoing art does not address the problems encountered when drying a multi-region cellulosic fibrous structure. For example, a first region of the cellulosic fibrous structure, having a lesser absolute moisture, density or basis weight than a second region, will typically have relatively greater air flow therethrough than the second region. This relatively greater air flow occurs because the first region of lesser absolute moisture, density or basis weight presents a proportionately lesser flow resistance to the air passing through such region. The greater air flow results in the preferential drying of these regions. Thus, vacuum drying and through-air drying each result in a web with a problematic non-uniform moisture distribution.

The ideal moisture distribution for a multiple region fibrous web is one where the different regions of the web simultaneously reach a uniform moisture level at the completion of the drying process.

As an example of the problem of achieving such a simultaneous uniform moisture distribution, when typical multi-region paper webs are transferred to a Yankee dryer, the webs have a non-uniform moisture distribution. The regions with a higher moisture content can be those in contact with the Yankee dryer. The Yankee dryer and hood combination preferentially dries those regions in contact with the dryer. The regions not in contact with the Yankee dryer, with much lower moisture content, are more completely dried by the Yankee hood. The ideal moisture distribution should be such that the moisture level of regions not in contact with the Yankee is somewhat less than those in contact with the dryer so there is uniform moisture at the end of the drying process. It is desirable to achieve such a moisture distribution without reducing the throughput speed of the Yankee and the entire process.

It would be advantageous to be able to adjust the differences in the moisture content between the regions in direct contact and those not in direct contact with the Yankee, prior to the Yankee, or other drying means in order to optimize the performance of the drying system, and to achieve higher throughput speeds.

Another drawback to the approaches in the prior art (except those that use mechanical compression, such as felt belts) is that each relies upon supporting the cellulosic fibrous structure to be dried. Air flow is directed towards the cellulosic fibrous structure and is transferred through the supporting belt, or, alternatively, flows through the drying belt to the cellulosic fibrous structure. Differences in flow resistance through the belt or through the cellulosic fibrous structure, amplify differences in moisture distribution within the cellulosic fibrous structure, and/or create differences in moisture distribution where none previously existed.

One improvement in the art which addresses this problem is illustrated by commonly assigned U.S. Pat. No. 5,274,930 issued Jan. 4, 1994 to Ensign et al. and discloses limiting-orifice drying of cellulosic fibrous structures in conjunction with through-air drying, which patent is incorporated herein by reference. This patent teaches an apparatus utilizing a micropore drying medium which has a greater flow resistance than some portion of the interstices between the fibers of the cellulosic fibrous structure. The micropore medium is therefore the limiting orifice in the through-air drying process so that at least a more uniform moisture distribution is achieved in the drying process.

Yet other improvements in the art which address the drying problems are illustrated by commonly assigned U.S. Pat. Nos. 5,543,107 issued Aug. 1, 1995 to Ensign et al.; 5,584,126 issued Dec. 19, 1996 to Ensign et al.; and 5,584,128 issued Dec. 17, 1996 to Ensign et al., the disclosures of which patents are incorporated herein by reference. The Ensign et al. '126 and Ensign et al. '128 patents teach multiple zone limiting orifice apparatuses for through air drying cellulosic fibrous structures. However, Ensign et al. '126, Ensign et al. '128, and Ensign et al. '930 do not teach how to increase the amount of interstitial water in the web that is brought into hydraulic contact with the pores of the limiting orifice medium.

Applicants have unexpectedly found that pressing the wet web against the limiting orifice medium, while drawing a vacuum through the medium greater than the breakthrough pressure of the pores, promotes greater and more rapid and more complete dewatering of the web.

Accordingly it is an objective of this invention to provide a method of dewatering a fibrous web that results in greater dewatering and a more uniform moisture distribution. It is a further objective of this invention to provide a method of dewatering that results in a reduction of the residence time necessary to dewater the web, and reduces the rewetting of the web at the exit of the pressing nip.

SUMMARY OF THE INVENTION

A method comprising supporting a web on a fluid permeable carrier; pressing the carrier and the web between a pressing device and a limiting orifice medium, and drawing a vacuum greater than the breakthrough pressure of the pores of the limiting orifice medium through the medium, the web and the carrier. Such a medium may be comprised of a plurality of pores with web contacting and non-web contacting surfaces.

In one embodiment, the pressing device may also be a fluid permeable roller. A positive pressure may be applied through the roller to the carrier and the web. Alternatively, suction may be applied to the carrier and the web through the pressing roller while suction is also applied through the limiting orifice medium. It is also possible to employ a fluid permeable pressing roller where no pressure differential is utilized across the pressing roller. It is further possible that such a fluid permeable pressing device may also be a limiting orifice medium.

The outer surface of the press roller may be soft enough that the surface will deform in the nip increasing the residence time of the web and carrier in the nip point. Overall residence time may also be increased through the use of multiple nip points.

The pressing device, the carrier and the limiting orifice medium may be heated either individually or in combination to improve the drying performance of the method.

DETAILED DESCRIPTION OF THE INVENTION

Figure 3:
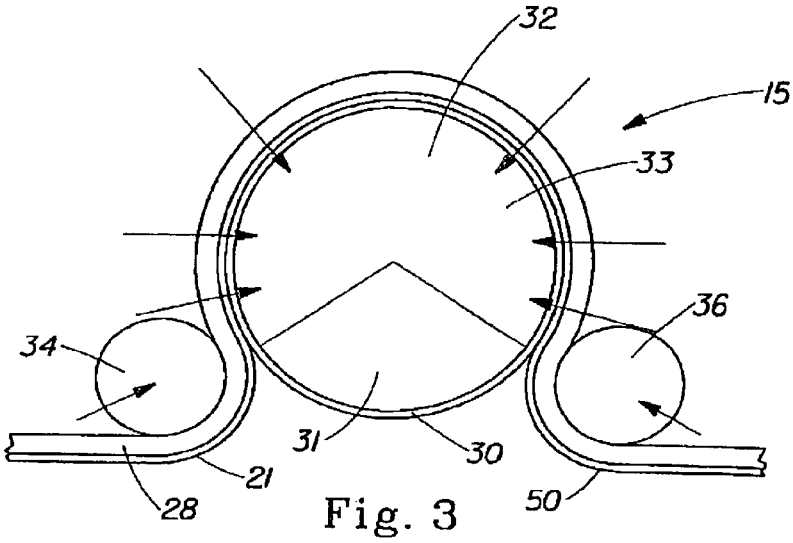
FIG. 3 is a schematic side elevational view of a limiting orifice medium according to the present invention embodied on a pervious cylinder which has a subatmospheric region, and a positive pressure region.

FIG. 3 illustrates one embodiment of the method of the present invention. A web 21 is supported on a belt 28. The web 21 and belt 28 are pressed between a limiting orifice medium 30 and a pressing device 34 and/or 36. A vacuum greater than the breakthrough pressure of the limiting orifice medium is drawn in sector 33 of the supporting cylinder 32.

As used herein "web" refers to a deposit of fibers subject to rearrangement during the papermaking process. The web may be formed according to any papermaking process known in the art including but not limited to: conventional fourdrinier, hybrid fourdrinier, and twin-wire forming. After the web 21 is formed it may be transferred from the forming wire to the drying belt 28 through the use of an open draw or a vacuum pick up shoe as is well known in the art.

The web 21 may be foreshortened prior to being introduced to the drying belt 28 and micropore medium 30 by wet microcontraction. Such foreshortening is taught in U.S. Pat. No. 4,440,597, issued Apr. 3, 1984 to Wells et al., the disclosure of which is incorporated herein by reference.

Figure 6:
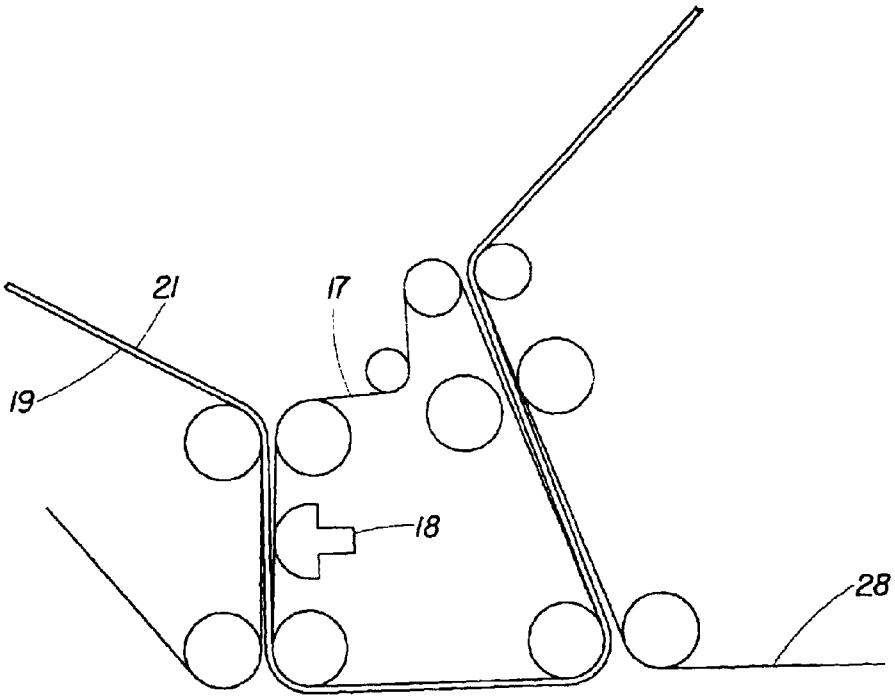
FIG. 6 is a fragmentary schematic view of a gap transfer used to foreshorten a fibrous web.

The web 21 may be foreshortened prior to being introduced to the drying belt 28 and limiting orifice medium 30. FIG. 6 illustrates such foreshortening, the web 21 is transferred from the forming wire 19 to a slower moving, high fiber support transfer wire 17. The web 21 may be transferred using a fixed gap, or kiss, transfer with sufficient space between the forming wire and the transfer wire such that the web 21 is not compressed in the transfer. The web 21 may be transferred using a transfer shoe 18 with the forming and transfer fabrics converging and diverging at the leading edge of the transfer shoe. The web 21 may subsequently be transferred to a drying belt 28 and be subsequently dried by the method of the present invention. U.S. Pat. No. 5,656,132 issued Aug. 12, 1997 to Farrington, Jr. et al., discloses such foreshortening and the disclosure of this patent is hereby incorporated by reference for the limited purpose of demonstrating the compatibility of foreshortening the web with the drying method of the present invention.

The web 21 comprises a network of fibers and interfiber spaces, or interstices, or pores. Interstitial water is the water occupying these interstices, or pores, of the web 21. When the relatively smaller pores of the limiting orifice medium come into contact with the relatively larger pores of the wet web, water will move out of the interstices of the web 21 and into the pores. This movement arises providing the surface energies and/or differential pressures are advantageous. The pressures created due to favorable surface energies and small pore sizes are capillary pressures. Only interstitial water in hydraulic contact with the pores of the limiting orifice medium 30 will be influenced by the capillary pressure exerted by the pores.

Interstitial water is considered to be in "hydraulic contact" with the pores of the limiting orifice medium 30 if such water is part of a continuum of water that is in direct contact with the web contacting surface and pores of the limiting orifice medium 30. This continuum of water is subject to the capillary pressure arising from the pore size differential between the fibrous web and the limiting orifice medium 30. By way of contrast, interstitial water in discrete quantities not continuously connected to the pores of the limiting orifice medium 30 and not subject to the capillary pressure created by the pore size differential is not considered hydraulically connected.

The application of a negative pressure in excess of the breakthrough pressure of the pores of the limiting orifice medium results in the movement of air through the web and into the pores. This movement entrains water in the web and either brings it into hydraulic contact with the pores, or carries it through the pores. The pressing of the wet web 21 and belt 28 between the limiting orifice medium 30 and pressing device 34 or 36, results in additional dewatering of the web 21.

The belt 28 may be any fluid permeable belt. One embodiment of the drying belt 28 utilizes a continuous photosensitive resinous network. Such an embodiment of drying belt 28 may be made in accordance with commonly assigned U.S. Pat. No. 4,528,239 issued Jul. 9, 1985 to Trokhan, which patent is incorporated herein by reference for the purpose of showing a drying belt 28 suitable for use with the present invention. If desired, the drying belt 28 may be provided with a textured backside.

The drying belt 28 may be cleansed with water showers (not shown) to remove fibers, adhesive, and the like which remain attached to the drying belt 28 after the sheet 50 is removed therefrom. The drying belt may also have an emulsion applied to act as a release agent and extend the useful life of the belt by reducing oxidative degradation. Preferred emulsion and distribution methods are disclosed in commonly assigned U.S. Pat. No. 5,073,235 issued Dec. 17, 1991, to Trokhan.

The drying belt 28 transports the web 21 to the apparatus 15 comprising a limiting orifice medium 30, a means for supporting this medium 32, a means for drawing a vacuum through the limiting orifice medium 30, the web 21, and the drying belt 28, and a means 34 and/or 36 for pressing the web 21 between the drying belt 28, and the limiting orifice medium 30.

Figure 5:
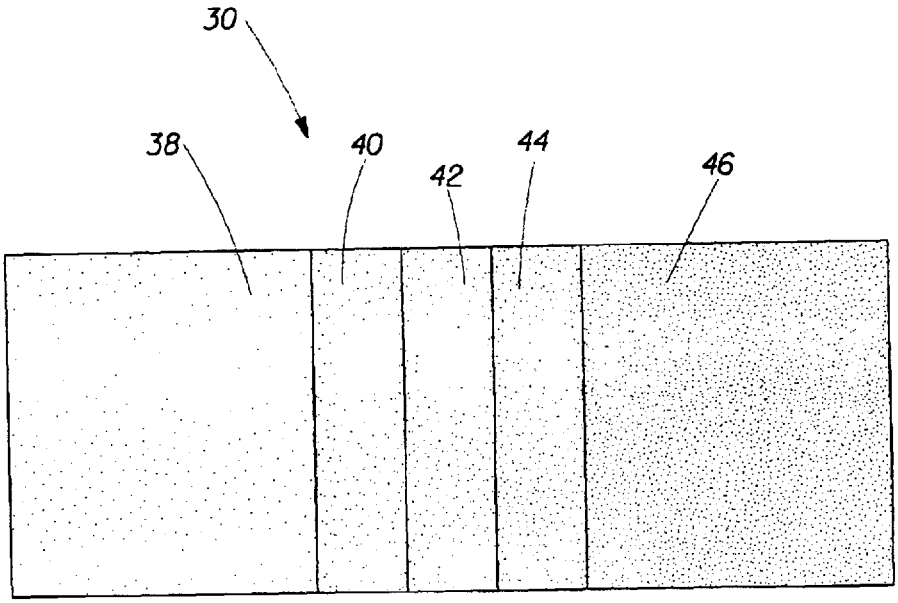
FIG. 5 is a fragmentary top plan view of a limiting orifice medium according to the present invention showing the various laminae.

As used herein a "limiting orifice medium" refers to any component which allows fluid flow therethrough and can be used to direct, tailor, refine or reduce air flow to another component. The limiting orifice medium has a plurality of pores with a functional pore size that is smaller than some portion of the pores of the other component. The other component may either be upstream or downstream of the limiting orifice medium. The limiting orifice medium 30 may be generally planar, as shown in FIG. 5, or embodied in any desired configuration. In one embodiment, the pores in the limiting orifice medium 30 are of lesser hydraulic radius than the interstices in the web 21, and are well distributed to provide substantially uniform air flow to all of the web 21 within the range of such air flow. Alternatively or additionally, air flow through the limiting orifice medium 30 may be influenced by providing a high resistance flow path (several turns, flow restrictions, small ducts, etc.) through the limiting orifice medium 30, providing the limiting orifices are still uniformly distributed. A hydraulic radius of a pore is the ratio of the surface area of the pore to the perimeter of the pore. The pores' resistance to fluid flow varies inversely to its hydraulic radius, i.e. as the hydraulic radius increases, resistance to flow decreases.

In one embodiment, the means for supporting the limiting orifice medium comprises a rotatable porous cylinder 32. The cylinder 32 may be divided internally into at least two non-rotating sectors to improve the operating energy efficiency of the system. One sector can be coincident with the portion of the perimeter of the cylinder between the points where the web 21 is transferred onto and off of the limiting orifice medium. A vacuum greater than the breakthrough pressure of the pores of the limiting orifice medium is applied to the medium and the web in this sector. Cleaning showers can be located in the positive pressure sector 31 to allow water to be sprayed from the inside of the cylinder through the limiting orifice medium to remove any contamination that has accumulated in the pores.

A subatmospheric pressure is a pressure less than one atmosphere of pressure. Such a pressure is also referred to as a negative, vacuum, or suction pressure. A pressure above one atmosphere is considered to be a positive pressure. The breakthrough pressure is found according to the Society of Automotive Engineers Aerospace Recommended Practice 901, issued Mar. 1, 1968, entitled Bubble Point Test Method, and modified to use a 50 millimeter immersion depth. This practice is incorporated herein by reference.

According to the test method, the media to be tested is immersed in A.C.S. reagent grade isopropyl alcohol at a depth of 50 mm. Gas pressure is applied beneath the medium so that the liquid phase, which was in the pores, is displaced by the gas. The flow rate of the gas is plotted against the gas pressure. At pressures prior to the formation of the first bubble, the plot is generally linear and relatively horizontal. After breakthrough, when bubbles are flowing freely through the medium, the plot is generally linear and relatively vertical. The horizontal and vertical portions of the plot are extrapolated so that the extrapolated lines intersect. The pressure corresponding to the point of intersection of the extrapolated lines is the breakthrough pressure of the medium.

One skilled in the art will understand that a vacuum greater than the breakthrough pressure of the pores refers to a greater level of vacuum, therefore a more negative pressure and an absolute pressure that is less than the breakthrough pressure of the pores.

The structure must be capable of supporting a vacuum in excess of the breakthrough pressure of the pores of the medium to be applied to the medium 30, the web 21, and the belt 28, and the nip load without collapsing. Such a vacuum pressure may be provided by the use of a vacuum pump, a fan or a blower coupled to the porous cylinder 32 to create a vacuum in the vacuum sector 33 of the cylinder.

When the web 21 and the drying belt 28 pass through a nip point, the web 21 and belt 28 are compacted and more interstitial water is moved into hydraulic contact with the limiting orifice medium 30. A "nip point" or "nip" is a localized point, or specific distance in the papermaking machine where the space available for the belt 28 and the web 21 is such that the web-belt combination is compressed. The nip point can be formed by a member, such as a roller or a fixed bar, parallel to the axis of the axially rotatable porous cylinder 32 and in such proximity to the cylinder 32 that the web 21 and the drying belt 28 are compressed when passing between the porous cylinder 32 and the opposing member. In one embodiment, a roller 34, may be used to press the belt 28 and web 21 immediately after the initiation of contact between the web 21 and the limiting orifice medium 30. Alternatively a roller 36 may be used to press the belt 28 and web 21 immediately prior to the cessation of contact between the web 21 and the limiting orifice medium 30.

The roller may be generally counter-balanced such that belt 28 and web 21 are subjected to only 1 pound per lineal inch (pli) of pressure at the nip point, resulting in a slight compression of the combination. It is possible to use the roller to press with considerable force (up to 600 pli) resulting in significant compression of the web 21 and belt 28, to bring more interstitial water into hydraulic contact with the pores of the limiting orifice medium 30. In another embodiment, the nip point can exert a pressure of between 50 and 500 pli on the web 21 and belt 28 combination. In yet another embodiment, the nip point can exert a pressure of between 250 and 400 pli on the web 21 and belt 28. The extent of the dewatering that occurs is directly related to the pressure in the nip.

The nature and extent of the compression of the web 21 can be influenced by the structure of the drying belt 28. When a drying belt 28 with a patterned surface is used, the nip point pressure can be configured such that the nip primarily compresses the portion of the web 21 coincident with the top most plane of the pattern of the belt 28. The compression of this portion of the web 21 against the limiting orifice medium 30 results in the preferential dewatering of this portion of the web 21. In a typical through-air drying process, this portion of the web has a higher moisture content after through-air drying than the portion of the web 21 coincident with the holes in the pattern of the drying belt 28. As a result of the disclosed method, the web portion that typically has a higher moisture content is preferentially dried, resulting in a more uniform moisture distribution than that produced by a typical through-air drying process.

The pattern of the drying belt 28 will determine the proportion of the web 21 that is compressed in such a nip. The design of the pattern can be such that between 10% and 75% of the web 21 is coincident with the top most layer of the drying belt 28. More specifically, the design of the belt 28 pattern can be such that between 20% and 65% of the web is coincident with the top most plane of the belt 28.

The press roller 34 can be fluid permeable or impermeable. A fluid permeable roller 34 can have the capacity to have a positive fluid pressure applied through it such that this pressure is applied to the web 21 at the nip point. Such an application serves to provide an additional force for moving interstitial water out of the web 21 and into the limiting orifice medium 30. Alternatively, the fluid permeable roller 34 may be utilized with a negative pressure through its pores. Such a pressure would act to augment any capillary pressure acting on water brought into hydraulic contact with the pores of the roller 34 as the web 21 and carrier 28 pass through the nip point. In another alternative, the permeable roller 34 could be utilized with no pressure differential across its pores. Such an application potentiates fluid flow through the web 21 while the web is under the mechanical pressure at the nip point. The roller 34 functions as a vacuum breaker to allow the continual equalization of the interstitial pressures as water moves toward the limiting orifice medium 30. In the absence of such equalization, additional force is necessary to move interstitial water due to the vacuum created as the water moves out of web 21 interstices toward the limiting orifice medium 30. The pores of the fluid permeable roller may be sized such that the roller also functions as a limiting orifice medium when pressure is applied through it. In such an embodiment, any differences in the fluid permeability of the drying belt or the fibrous web would not amplify or create differences in the moisture distribution of the web.

Throughput speed is a major factor in determining the economics of a papermaking operation. As this speed increases the residence time of the fibrous web 21 in a given part of the papermaking apparatus is decreased together with the time for any forces brought to bear on the web 21 in that part of the apparatus 15. Interstitial water will move within the web during the time that sufficient pressure is acting upon it. Increasing the time during which sufficient pressure acts will result in an increased amount of water being removed from the web.

One way to increase the time that pressures act upon interstitial water to move it out of the web is by operating the drying apparatus of the present invention at a vacuum level above the breakthrough pressure of the pores of the limiting orifice medium. Such operation will create differential pressures favorable to moving water from the web into the medium. The pressure will act on the water as long as the web and medium are in contact with each other and the pressure is above the breakthrough pressure.

One way to increase this residence time is the use of multiple press rollers in two or more nip points. Alternatively, or additionally, the roller 34 can have a soft outer cover such that the pressure of the nip point will deform the cover and result in greater surface contact between the roller and the limiting orifice medium. Greater contact area in the nip results in more residence time in the nip point. The extent of the deformation of the press roller 34, and carrier 28, in the nip point will determine the contact area of the nip, the pressing pressure of the nip, and the residence time in the nip based upon the throughput speed.

The pressing pressure will be the nip pressure measured in pounds per lineal inch along the length of the nip point, divided by the surface contact area along each lineal inch of the nip. In one embodiment, the pressing pressure can be varied from about 1 to about 10,000 pounds per square inch (psi). In another embodiment, the pressing pressure can be varied from about 10 to about 3500 psi (pounds per square inch). In yet another embodiment, the pressing pressure can be varied from about 20 to about 2000 psi. Depending upon the amount of distortion of the cover of the nip roller and the speed of operation, and pressing means the dwell time in the nip may vary from about 0.0005 to about 0.3 seconds.

Figure 1:
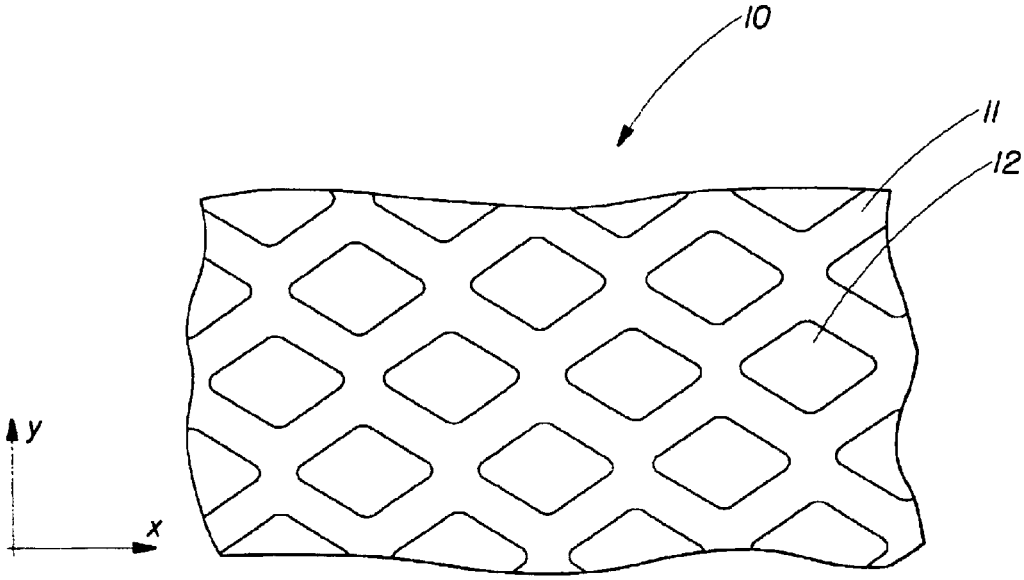
FIG. 1 is a fragmentary top plan view of a multiple region cellulosic fibrous structure made according to the present invention.
Figure 2:
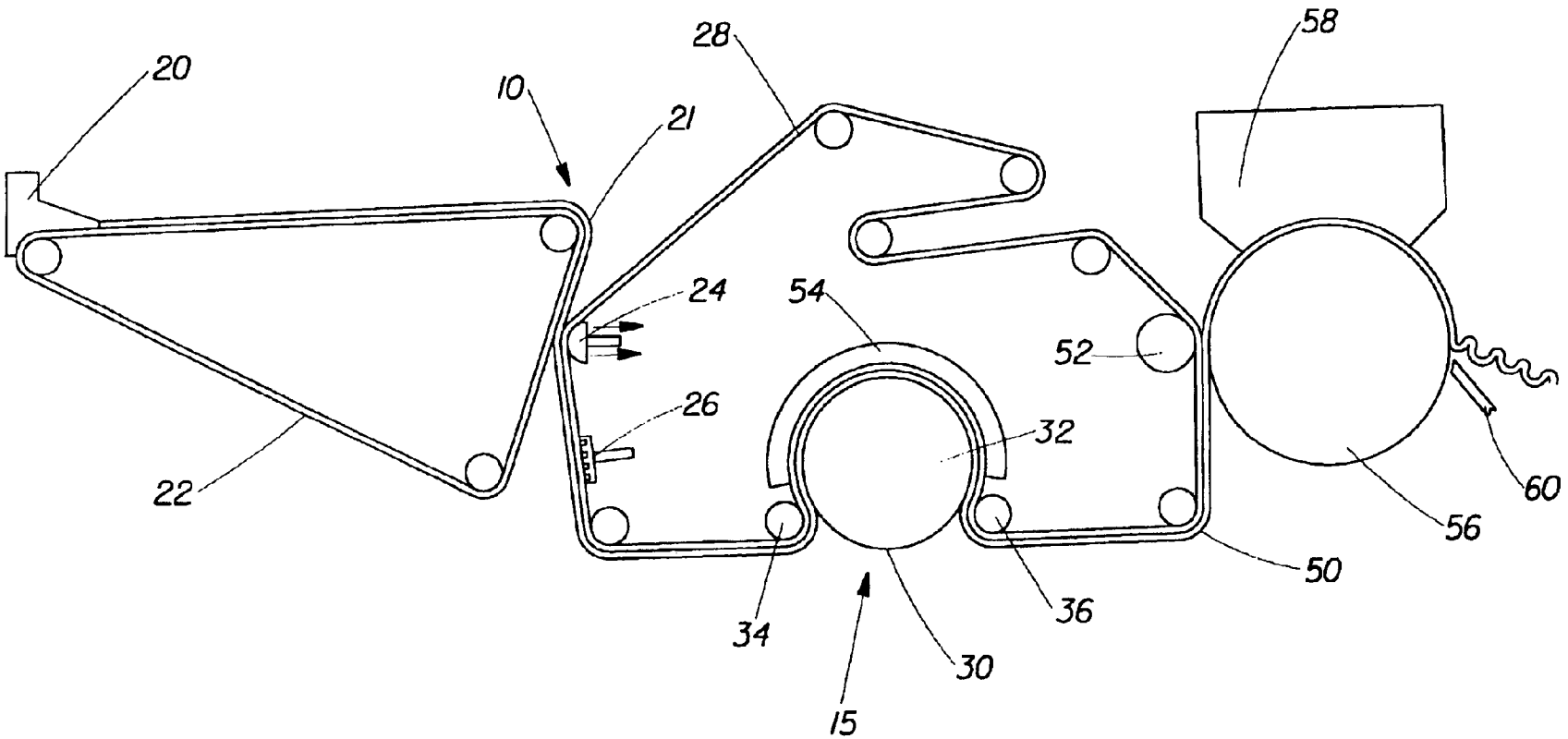
FIG. 2 is a schematic side elevational view of a papermaking machine according to the present invention.

Referring to FIG. 2, the apparatus 15 used to manufacture the cellulosic fibrous structure 10 may be further provided with a hood 54, to supply air to dry the web 21. Particularly, the hood 54 provides dry air for the air flow through the web 21. It is important that the air flow not add water to the web 21, but instead be capable of removing water through evaporation and mechanical entrainment. It is noted, however, that saturated air may be suitable, if only mechanical dewatering is intended. The hood 54 is able to provide air flow at a temperature from ambient to about 290 degrees C. (500 degrees F.) and more specifically, from about 93 to about 150 degrees C. (200 to 300 degrees F.) for the air flow through the web 21.

One advantage of using relatively lower temperature air (at or near ambient temperature) is the reduced proclivity of the drying belt 28 and web 21 to prematurely fail, or to scorch, burn, or develop malodors during the manufacturing process when using lower temperature air flows, as well as potential energy savings. Such a hood 54 may be constructed and supplied in accordance with the means and skills ordinarily known in the art and will not be further herein described.

The limiting orifice medium 30, may also be heated to assist in the dewatering process. The medium 30 may be heated by the use of induction heating, by the internal circulation of a heat transfer material, infrared heating or the use of a steam hood. The medium may be heated to a temperature of between about 38 and 290 degrees C. (100 and 500 degrees F.).

The web 21 may have a consistency from about 5 to about 50 percent when introduced to the limiting orifice medium 30 and porous cylinder 32. Such a web may be dried to a consistency from about 20 to about 100 percent. The final consistency will depend upon the incoming moisture, fiber composition, the Canadian Standard Freeness of the furnish, the basis weight of the web 21, the residence time of the web 21 on the limiting orifice medium 30, the functional pores size of the limiting orifice medium 30, and the pressing pressure in the nip. The extent of drying is also dependent upon the moisture saturation, flow rate, and temperature of air flowing through the web 21. Consistency refers to the percentage of the web that is not water. Therefore a web with a consistency of 5% is 95% water.

Referring again to FIG. 2, after the web 21 leaves the porous cylinder 32 having the limiting orifice medium 30, the web 21 is considered to be a limiting orifice dried sheet 50. If additional drying is necessary, the limiting orifice dried sheet 50, may then be transported on the drying belt 28 from a takeoff roll 36 to another dryer such as a through-air dryer, an infrared dryer, a non-thermal dryer, a conductive dryer such as a Yankee drying drum 56, or an impingement dryer, such as a hood 58, which dryers may either be used alone or in combination with other drying means. A conductive dryer is a heated cylinder that dries the web by direct contact between the web 21 and the cylinder allowing heat to be conducted into the web 21.

More specifically, the web may be introduced to the limiting orifice medium with a consistency from about 6% and about 32%. The web may be dried by the additional step of through-air drying to a consistency from about 50% and about 90%. It is possible to through-air dry the web to a consistency of about 94% while the web is still being supported by the drying belt 28. Such a dried web 21 may then be removed from the drying belt 28 without creping the web 21.

Figure 7:
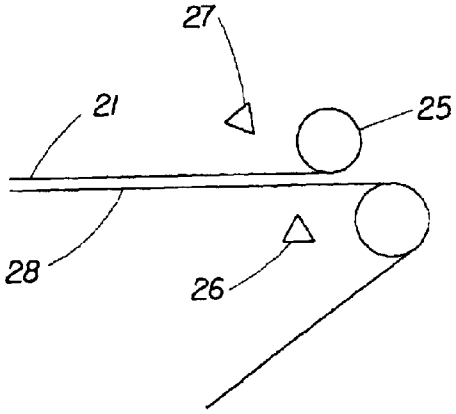
FIG. 7 is a fragmentary schematic view of an apparatus for removing a fibrous web from a belt without creping the web.

The web 21 may be removed without creping by any of several methods known in the art. Referring to FIG. 7, the web 21 may be removed without creping by bringing a winding core 25 into contact with the web 21, providing an adhesive at the contact area between the web 21 and the core 25, and applying a positive air pressure through the belt 28 to the web 21 moving the web 21 from the belt 28 to the core 25. The web 21 will then continue to leave the belt 28 and wind onto the core 25 as the core 25 is rotated.

The manufacturing process described herein is particularly suited for use with a Yankee drying drum 56. When using a Yankee drying drum 56 in this manufacturing process, heat from the Yankee drying drum 56 circumference is conducted to the limiting-orifice-through-air dried web 50 which is in contact with the Yankee drying drum 56 circumference. The limiting orifice dried sheet 50 may be transferred from the drying belt 28 to the Yankee drying drum 56 by means of a pressure roll 52, or by any other means well known in the art. After transfer of the limiting orifice dried sheet 50 to the Yankee drying drum 56, the limiting orifice dried sheet 50 is dried on the Yankee drying drum 56 to a consistency of at least about 90 percent.

The limiting orifice dried sheet 50 may be temporarily adhered to the Yankee drying drum 56 through use of creping adhesive. Typical creping adhesive includes polyvinyl alcohol based glues, such as disclosed in U.S. Pat. No. 3,926,716 issued Dec. 16, 1975 to Bates, which patent is incorporated herein by reference for the purpose of showing an adhesive suitable for adhering a limiting orifice dried sheet 50 to a Yankee drying drum 56 by application of such adhesive to either.

Optionally, the dry sheet may be foreshortened, so that its length in the machine direction is reduced and the cellulosic fibers are rearranged with disruption of the fiber to fiber bonds. Foreshortening can be accomplished in several ways, the most common, well known in the art and preferred being creping. In a creping operation, the limiting-orifice-through-air dried sheet 50 is adhered to a rigid surface, such as that of the Yankee drying drum 56, then removed from that surface with a doctor blade 60. After creping and removal from the Yankee drying drum 56, the dry sheet 50 may be calendered or otherwise converted as desired.

In one embodiment, the limiting orifice medium 30 and the web 21 should be in a contacting relationship to prevent a plenum from being created therebetween and also to prevent the air flow to or through the web 21 from being limited by the flow resistance of the individual regions thereof. The plenum allows air flow lateral to the web 21 to occur and may prevent the desirable uniform air flow to or through the web 21. As used herein, air flow is considered to be "lateral" when such air flow has a principal direction of travel which is parallel to the plane of the limiting orifice medium 30 when such air flow is in the vicinity of the web 21. Alternatively, the web 21 may be spaced a small distance from the limiting orifice medium 30, providing an intermediate grid seals the air flow therebetween. This arrangement minimizes contamination and abrasion of the limiting orifice medium 30 by the web 21.

The effectiveness of pressing the web 21 and belt 28 against the limiting orifice medium 30 while drawing a vacuum greater than the breakthrough pressure through the pores is such that less residence time is required for efficient drying. That is, the process produces a web with a consistency equivalent to that produced by typical through-air drying or limiting orifice through-air drying in less time. Subsequently, smaller diameter rollers 32 may be utilized to practice the disclosed method. The rollers are small in comparison to a typical through-air drying or limiting orifice through-air drying roller. The use of smaller rollers 32 makes it easier and less expensive to retrofit existing papermaking machines to utilize the method since less space is required for the equipment. The smaller circumference of the roller 32, and the use of a sectored roller also allows equivalent drying while using less horsepower to drive the pump, fan or blower utilized to provide the vacuum and air flow necessary to the process. As an example of the difference in roller size that is possible, a typical limiting orifice drying roller is 183 cm. (72 in.) in diameter. The disclosed method may be practiced with a roller that is 107 cm (42 in) in diameter.

As illustrated by FIG. 3, the same air flow that dries the web 21 finally passes through the limiting orifice medium 30 to the porous cylinder 32 and its interior. Therefore, the flow path through the limiting orifice medium 30 must be sized and configured to provide a limiting orifice in the path of such air flow. As used herein, the "flow path" refers to an area or combination of areas through which air flow is directed as part of the drying process.

As illustrated in FIG. 5, the limiting orifice medium 30 may be made of a laminar construction. However, it is understood that a single lamina limiting orifice medium 30 may be feasible, depending upon its strength, the particular combination of pressure differentials and flow resistances described above utilized for the selected papermaking process.

The limiting orifice medium 30, and the entire apparatus 15 used to manufacture the cellulosic fibrous structure 10 may be thought of as having a "Machine Direction" and a "Cross Direction". As used herein the "Machine Direction" (MD) refers to the direction parallel to the transport of the cellulosic fibrous structure 10 throughout the papermaking apparatus 15. As used herein the "Cross Direction" (CD) refers to the direction parallel to the plane of transport of the cellulosic fibrous structure and orthogonal to the machine direction.

As an example, the first through fifth lamina 38, 40, 42, 44, and 46 of the limiting orifice medium 30 may be made of any material suitable to withstand the heat, moisture, and pressure indigenous to and incidental to the papermaking process without imparting deleterious effects or properties to the web 21. It is important that the limiting orifice medium 30 be substantially incompressible and that the laminate not excessively deflect or deform normal to the plane of the web 21 during manufacture, otherwise the desirable uniform air flow therethrough, may not be maintained. Any combination of lamina 38, 40, 42, 44, and 46 or other components which provides a flow resistance that is the limiting orifice in the flow path and does not deflect or less than adequately support the web 21 in operation is suitable for the limiting orifice medium 30. It is only necessary that each lamina 38, 40, 42, or 44 be supported by the adjacent lamina 40, 42, 44, or 46 without excessive deflection.

For one embodiment described herein, a laminate having a first lamina 38 which is closest to, and may even be in contacting relationship with the web 21, and having a functional pore size of about six to seven microns across may be utilized. Such a first lamina 38 may be formed by a Dutch twill weave of metallic MD and CD fibers. The MD fibers may have a diameter of about 0.038 millimeters (0.0015 inches). The CD fibers may have a diameter of about 0.025 millimeters (0.001 inches). The MD and CD fibers may be woven into a first lamina 38 having a caliper of about 0.071 millimeters (0.0028 inches) and a count of about 128 fibers per centimeter (325 fibers per inch) in the machine direction and about 906 fibers per centimeter (2,300 fibers per inch) in the cross direction. The first lamina 38 may be calendered, as desired, to decrease its functional pore size.

For one embodiment described herein, a laminate having a second lamina 40 which is adjacent to and in contact with the first lamina 38, and having a functional pore size of about 93 microns, may be utilized. Such a second lamina 40 may be formed by a plain square weave of metallic MD and CD fibers. The MD fibers may have a diameter of about 0.076 millimeters (0.003 inches). The CD fibers may have a diameter of about 0.076 millimeters (0.003 inches). The MD and CD fibers may be woven into a lamina having a caliper of about 0.152 millimeters (0.006 inches) and a count of about 59 fibers per centimeter (150 fibers per inch) in the machine direction and about 59 fibers per centimeter (150 fibers per inch) in the cross direction.

For one embodiment described herein, a laminate having a third lamina 42 which is adjacent to and in contact with the second lamina 40, having a functional pore size of about 234 microns (0.092 inches), a count of about 24 fibers per centimeter (60 fibers per inch) in the machine direction and about 24 fibers per centimeter (60 fibers per inch) in the cross direction, is suitable. Such a third lamina 42 may be formed by a plain square weave of metallic MD and CD fibers. The MD fibers may have a diameter of about 0.191 millimeters (0.075 inches). The CD fibers may have a diameter of about 0.191 millimeters (0.075 inches). The MD and CD fibers may be woven into a lamina having a caliper of about 0.254 millimeters (0.010 inches) and a count of about 24 fibers per centimeter (60 fibers per inch) in the machine direction and about 24 fibers per centimeter (60 fibers per inch) in the cross direction.

For one embodiment described herein, a laminate having a fourth lamina 44 which is adjacent to the third lamina 42, having a functional pore size of about 265 to about 285 microns, may be utilized. Such a fourth lamina 44 may be formed by a plain Dutch weave of metallic MD and CD fibers. The MD fibers may have a diameter of about 0.584 millimeters (0.023 inches). The CD fibers may have a diameter of about 0.419 millimeters (0.0165 inches). The MD and CD fibers may be woven into a lamina having a caliper of about 0.813 millimeters (0.032 inches) and a count of about 5 fibers per centimeter (12 fibers per inch) in the machine direction and about 25 fibers per centimeter (64 fibers per inch) in the cross direction.

For one embodiment described herein, the fifth lamina 46 is adjacent the fourth lamina 44 and in contact with the periphery of the porous cylinder 32. The fifth lamina 46 is made of a perforate metal plate. A perforate plate having a thickness of about 1.52 millimeters (0.060 inches) and provided with 2.38 millimeters (0.0938 inches) diameter holes staggered at a 60 degree angle and equally and isometrically spaced about 4.76 millimeters (0.188 inches) from the adjacent holes.

The first through fourth lamina 38, 40, 42, and 44 of a suitable limiting orifice medium 30 may be made of 304L stainless steel. The fifth lamina 46 may be made of 304 stainless steel. A suitable limiting orifice medium 30 may be supplied by the Purolator Products Company of Greensboro, N.C. as Poroplate Part No. 1742180-07. If desired, the first lamina 38 may be ordered directly from Haver & Boecker of Oelde Westfalen, Germany as 325×2300 (DTW 8) fabric, calendered as desired, up to about 10 percent thickness reduction.

The limiting orifice medium 30 may be full penetration welded from the fifth lamina 46 to the first lamina 38, to form the desired shape and size of the limiting orifice medium 30. A particularly desired shape is a cylindrical shell, for application onto the porous cylinder 32. The limiting orifice medium 30 shaped like a cylindrical shell may be joined to the porous cylinder 32 by a shrink fit. To accomplish the shrink fit, the limiting orifice medium 30 may be heated, without contamination from the heating means, then disposed on the outside of the porous cylinder 32 and allowed to shrink therearound as the limiting orifice medium 30 cools. The shrink fit should be sufficient to prevent angular deflection between the limiting orifice medium 30 and the porous cylinder 32 and sufficient to minimize any asperities in the lamina 38, 40, 42, 44, and 46 of the limiting orifice medium 30, without imparting undue stresses thereto.

The porous cylinder 32 may be provided with a periphery (not shown) adapted to accommodate the cylindrical shaped limiting orifice medium 30. The periphery may also be cylindrically shaped and provided with a plurality of holes therethrough. The holes may be about 4.3 millimeters (0.17 inches) in diameter and axially and radially offset about 5.5 to about 8 millimeters (0.21 to 0.30 inches) from the holes in the next row. This arrangement provides a periphery having about 28.5% open area.

Of course, it is not necessary that the exact arrangement, number, or size of lamina 38, 40, 42, 44, and 46 described above be utilized to obtain the benefits of the present invention. Thus, any combination of first lamina 38 and adjacent lamina 40, 42, 44, and 46 having pores or holes which provide the sufficient and proper flow resistance and are small enough to prevent deflection of the superjacent lamina into the pores or holes is adequate.

Generally, a plural lamina limiting orifice medium 30 having increasing pore sizes in the direction of downstream air flow promotes lateral flow of the air, in the plane parallel that of the web 21, through the limiting orifice medium 30. Of course, it is important that the principal air flow occur normal to the plane of the web 21, so that in addition to evaporative losses, water is removed from the web 21 while the water is still in the liquid form.

It is desirable to have the first lamina 38, i.e. that which provides the greatest flow resistance and typically would have the finest pores therethrough, on one surface of the limiting orifice medium 30, and particularly on the surface of the limiting orifice medium 30 which is in contacting relationship with the web 21. This arrangement reduces lateral air flow through the limiting orifice medium 30 and minimizes any non-uniform air distributions associated with such lateral air flow.

It is particularly desirable that liquid water be removed from the web 21, so that energy is not wasted overcoming the latent heat of vaporization of the liquid in the evaporative process. Thus by using the apparatus 15 and process described herein, energy is efficiently utilized by dewatering the web 21 through mechanical entrainment of liquid water and evaporation of water vapor. This removal is enhanced by the compressing of the belt 28 and web 21 in the nip point such that additional water is moved into hydraulic contact with the limiting orifice medium 30 and removed from the web 21.

By utilizing a limiting orifice medium 30 having the 128 MD count per centimeter by 906 CD count per centimeter disclosed above and a functional pore size of about six microns, it can be ensured that such a limiting orifice medium 30 will be the limiting orifice for air flow through a web 21 having a caliper of about 0.15 to about 1.0 millimeters (0.006 to 0.040 inches), and a basis weight of about 0.013 kilograms per square meter to about 0.065 kilograms per square meter (eight to forty pounds per 3,000 square feet). It is to be recognized, however that as the pressure differential across the web 21 and limiting orifice medium 30 increases or decreases and, the basis weight or density of the web 21 increases or decreases, the pore sizes of the lamina 38, 40, 42, 44, and 46, particularly of the first lamina 38 in contact with the web 21, may have to be adjusted accordingly. Particularly, the limiting orifice medium may have pores ranging from about 0.8 microns in diameter for the smallest to about 120 microns diameter for the largest pores. More specifically, the pores may range from about 2 to about 40 microns in diameter. More specifically still, the pores may range from about 5 to about 20 microns in diameter.

Figure 4:
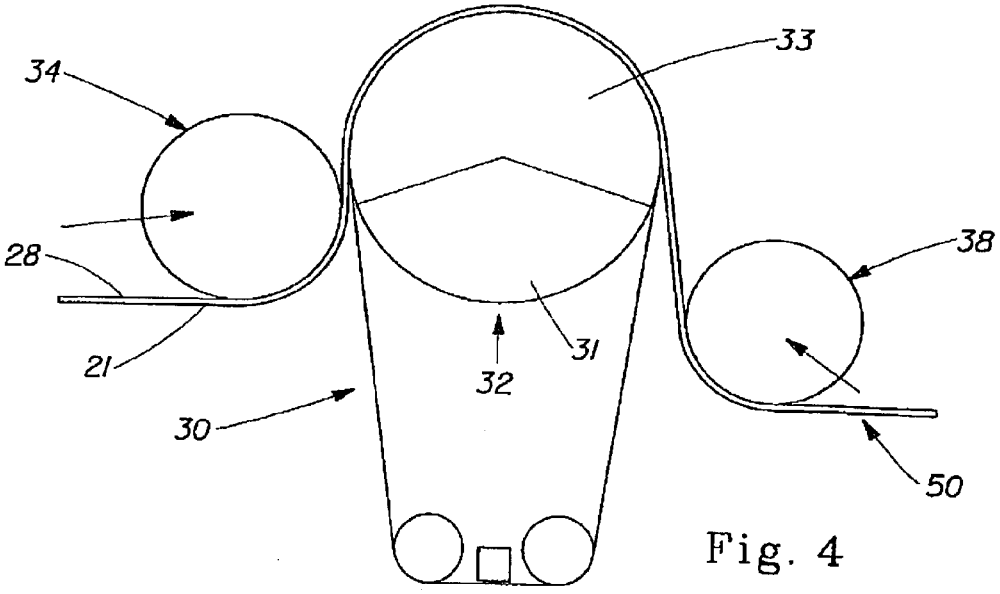
FIG. 4 is a schematic side elevational view of a limiting orifice medium according to the present invention embodied as an endless belt.
Figure 4A:
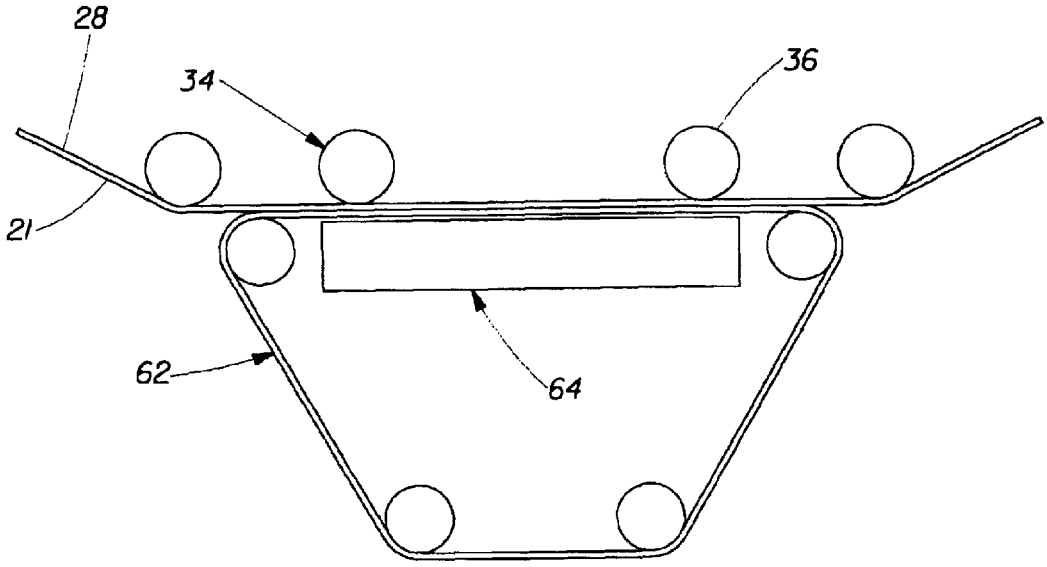
FIG. 4A is a schematic side elevational view of a limiting orifice medium according to the present invention embodied as an endless belt configured to be pressed against a fixed member of the papermaking machine.

In another variation illustrated in FIG. 4, the limiting orifice medium 30 is embodied in the form of an endless belt 62. Such an endless belt 62 parallels the drying belt 28 for a distance sufficient to obtain the desired residence time, discussed above. The web 21 is intermediate the belt 62, comprising the limiting orifice medium 30, and the drying belt 28. As discussed above relative to FIG. 3, such a belt 62 may be made of a single lamina of metal, polyester or nylon fibers having a mesh size and count sufficient, as described above, to be the limiting orifice in the air flow through the web 21. In this variation, the belt 62, the drying belt 28, and the web 21 therebetween, pass through a nip comprising two axially rotatable rollers (FIG. 4). It is also possible to pass the belt 62, the web 21, and the drying belt 28 between one or more rollers in opposition to a fixed member 64 (FIG. 4A). The member 64 supporting the belt 62 in the nip must be fluid permeable and capable of supporting a vacuum greater than the breakthrough pressure of the pores of the belt 62.

The embodiment of the limiting orifice medium 30 wrapped around a porous cylinder 32, illustrated in FIGS. 2–3 above, prophetically enjoys certain advantages over a limiting orifice medium 30 embodied in a belt 62. For example, a porous cylinder 32 type limiting orifice medium 30 would be expected to have greater integrity and longer life.

Conversely, the endless belt 62 embodiment of the limiting orifice medium 30 has fewer seams to impact the structure of the web 21. The belt 62 is also preferentially easier to clean, as cleaning may be accomplished by normal shower techniques. Furthermore, a single lamina polyester belt has the advantage that more of the cleaning shower is actually expelled through the pores in the limiting orifice medium 30 in a uniform manner. In a multi-lamina limiting orifice medium 30, such as illustrated in FIG. 5, much of the cleaning water is channeled in lateral flow between or through adjacent lamina 38, 40, 42, 44, and 46 and due, in part, to the hole pattern in the periphery of the porous cylinder 32, is not uniformly expelled through the finest pores of the first lamina 38 where it is most needed.

Additionally, the influence of the seams of the belt 62 upon the structure of the finished paper are less than the influence of the seams of a wrapped porous cylinder 32. Instead of the woven lamina 38, 40, 42, 44, and 46 embodiment of the limiting orifice medium 30 discussed above, it is possible that the limiting orifice medium 30 may be chemically etched, may be made of hot, isostatically pressed sintered metal, or may be made in accordance with the teachings of the aforementioned commonly assigned U.S. Pat. No. 4,556,450 issued Dec. 3, 1985 to Chuang et al.

It will be apparent that there are many other embodiments and variations of this invention, all of which are within the scope of the appended claims.

What is claimed is:

1. A method of reducing the moisture content of a fibrous web, the method comprising the steps of:

a) supporting the fibrous web on a fluid permeable carrier;

b) providing at least one limiting orifice medium comprising a plurality of pores having a breakthrough pressure;

c) pressing the fibrous web between the fluid permeable carrier and the limiting orifice medium a pressure in the range of about 1 to about 600 pli; and d) applying a vacuum to the pores of the limiting orifice medium, wherein the vacuum is greater than the breakthrough pressure of the pores of the limiting orifice medium such that air moves through the fibrous web and into the pores of the limiting orifice medium.

2. The method according to claim 1 wherein the step of providing a limiting orifice medium further comprises providing a limiting orifice medium that is substantially incompressible.

3. The method according to claim 1 wherein the step of providing a limiting orifice medium further comprises providing a limiting orifice medium comprising capillary pores, wherein the capillary pores have an effective diameter in the range of 0.8 to 120 micro-meters.

4. The method according to claim 3 wherein the step of providing a limiting orifice medium further comprises providing a limiting orifice medium wherein the capillary pores have an effective diameter in the range of 2 to 40 micrometers.

5. The method according to claim 4 wherein the step of providing a limiting orifice medium further comprises providing a limiting orifice medium wherein the capillary pores have an effective diameter in the range of 5 to 20 micrometers.

6. The method according to claim 1 wherein the step of pressing the fibrous web between the fluid permeable carrier and the limiting orifice medium comprises pressing the fibrous web between the fluid permeable carrier and the limiting orifice medium in at least two independent nips.

7. The method according to claim 1 wherein the step of pressing the fibrous web between the fluid permeable carrier and the limiting orifice medium comprises pressing with the pressing pressure in the range of about 50 to about 500 pli.

8. The method according to claim 7 wherein the step of pressing the fibrous web between the fluid permeable carrier and the limiting orifice medium comprises pressing with the pressing pressure in the range from about 250 to about 400 pli.

9. The method according to claim 1 wherein the step of pressing the fibrous web between the fluid permeable carrier and the limiting orifice medium comprises pressing with the pressing pressure in the range of about 1 to about 10,000 psi.

10. The method according to claim 9 wherein the step of pressing the fibrous web between the fluid permeable carrier and the limiting orifice medium comprises pressing with the pressing pressure in the range of about 10 to about 3500 psi.

11. The method according to claim 10 wherein the step of pressing the fibrous web between the fluid permeable carrier and the limiting orifice medium comprises pressing with the pressing pressure in the range of about 20 to about 2000 psi.

12. The method according to claim 1 wherein in the step of providing a fluid permeable carrier, the fluid-permeable carrier is patterned, and wherein in the step of pressing the fibrous web between the fluid permeable carrier and the limiting orifice medium, the patterned fluid permeable carrier primarily compacts the top-most plane of the web.

13. The method according to claim 1 wherein the step of pressing the fibrous web between the fluid permeable carrier and the limiting orifice medium comprises pressing the fibrous web and the fluid permeable carrier between a fluid-permeable pressing device and the limiting orifice medium.

14. The method according to claim 13 wherein the step of pressing the fibrous web and the fluid permeable carrier between a fluid-permeable pressing device and the limiting orifice medium further comprises applying a positive pressure through the fluid-permeable pressing device.

15. A method according to claim 13 wherein the step of pressing the fibrous web and the fluid permeable carrier between a fluid-permeable pressing device and the limiting orifice medium further comprises applying a negative pressure through the permeable pressing device.

16. The method according to claim 15 wherein the step of pressing the fibrous web and the fluid permeable carrier between a fluid-permeable pressing device and the limiting orifice medium further comprises pressing the fibrous web and fluid permeable carrier between two limiting orifice media.

17. The method according to claim 1 wherein the step of providing a limiting orifice medium comprises providing the limiting orifice medium with a surface temperature of between about 100 degrees F. and about 500 degrees F.

18. A method of removing a portion of the liquid contained in a wet fibrous web, the method comprising the steps of:

a) supporting the web on a forming fabric;

b) dewatering the web to a consistency from about 6% to about 32%:

c) transferring the web from the forming fabric to a fluid-permeable patterned carrier;

d) providing a limiting orifice medium comprising a plurality of pores having a breakthrough pressure;

e) pressing the web between the fluid-permeable patterned carrier and the limiting orifice medium at a pressure in the range of about 1 to about 600 pli; and f) applying a vacuum to the pores of the limiting orifice medium, wherein the vacuum is greater than the breakthrough pressure of the pores of the limiting orifice medium such that air moves through the fibrous web and into die cores of the limiting orifice medium.

19. The method according to claim 18 further comprising the step of maintaining the web in contact with the limiting orifice medium and under a pressure for a period of time in the range from about 0.0005 to about 0.3 sec.

20. A The method according to claim 18 wherein the step of transferring the web from the forming fabric to a fluid-permeable patterned carrier comprises transferring the web to the fluid-permeable patterned carrier wherein the fluid-permeable patterned carrier has a top-most-surface plane area of between about 10% and about 75% of a total surface area of the carrier.

21. The method according to claim 20 wherein the step of transferring the web from the forming fabric to a fluid-permeable patterned carrier comprises transferring the web to the fluid-permeable patterned cater wherein the fluid-permeable patterned carrier has a top-most-surface plane area of between about 20% and about 65% of the total surface area of the carrier.

22. The method according to claim 18 further comprising the step of foreshortening the web prior to the step of pressing the web between the fluid permeable patterned cater and the limiting orifice medium.

23. The method according to claim 18 further comprising the step of through-air drying the web to a consistency of between about 50% and about 90%.

24. The method according to claim 23 comprising the step of through-air drying the web to a consistency of about 94% on the fluid permeable patterned carrier.

25. The method according to claim 24 comprising the step of removing the dry web from the patterned cater without creping.

26. The method according to claim 23 further comprising the step of transferring the web to a conductive dryer.

27. A method of reducing the moisture content of a fibrous web in a web-making process, the method comprising the steps of:

a) supporting the web on a fluid permeable carrier;

b) providing a limiting orifice medium wherein the limiting orifice medium comprises a woven material further comprising a plurality of pores having a breakthrough pressure;

c) pressing the fibrous web between the fluid permeable cater and the limiting orifice medium at a pressure in the range of about 1 to about 600 pli; and d) applying a vacuum to the pores of the limiting orifice medium, wherein the vacuum is greater than the breakthrough pressure of the pores of the limiting orifice medium such that air moves through the fibrous web and into the pores of the limiting orifice medium.

28. A method of reducing the moisture content of a fibrous web in a web-making process, the method comprising the steps of:

a) supporting the web on a fluid permeable carrier;

b) providing a limiting orifice medium wherein the limiting orifice medium comprises an endless belt further comprising a plurality of pores having a breakthrough pressure;

c) pressing the web between the fluid permeable carrier and the limiting orifice medium at a pressure in the range of about 1 to about 600 pli; and d) applying a vacuum to the pares of the limiting orifice medium, wherein the vacuum is greater than the breakthrough pressure of the pores of the limiting orifice medium such that air moves through the fibrous web and into the pores of the limiting orifice medium.

* * * * *

UNITED STATES PATENT AND TRADEMARK OFFICE

CERTIFICATE OF CORRECTION

PATENT NO. : 6,746,573 B2
DATED : June 8, 2004
INVENTOR(S) : Michael Gomer Stelljes Jr. et al.

It is certified that error appears in the above-identified patent and that said Letters Patent is hereby corrected as shown below:

Column 17,
Line 3, “die cores” should read -- the pores --.
Lines 18, 25 and 33, “cater” should read -- carrier --.

Column 18,
Line 11, “cater” should read -- carrier --.
Line 30, “pares” should read -- pores --.

Signed and Sealed this

Twenty-second Day of November, 2005

JON W. DUDAS
*Director of the United States Patent and Trademark Office*